United States Patent [19]

Crawley

[11] 4,114,317

[45] Sep. 19, 1978

[54] WINDOW AND DOOR CONSTRUCTION

[76] Inventor: Richard K. Crawley, Box 29, North Star Rte., Dover, Ark. 72837

[21] Appl. No.: 752,106

[22] Filed: Dec. 20, 1976

[51] Int. Cl.[2] ..... E05D 15/10

[52] U.S. Cl. ..... 49/209; 49/225; 49/449

[58] Field of Search ..... 49/209, 221, 225, 415, 49/419, 423, 213, 449

[56] References Cited

U.S. PATENT DOCUMENTS

| | | | |
|---|---|---|---|
| 3,111,727 | 11/1963 | Gerecke | 49/225 X |
| 3,209,411 | 10/1965 | Sprague, Jr. | 49/225 |
| 3,225,393 | 12/1965 | Coller | 49/213 |
| 3,538,642 | 11/1970 | Fredricksen | 49/225 X |
| 3,660,936 | 5/1972 | Bryson | 49/209 |
| 3,947,998 | 4/1976 | Matsubara | 49/209 |

*Primary Examiner*—Philip C. Kannan

*Attorney, Agent, or Firm*—J. Michael McClanahan

[57] ABSTRACT

A window and door construction having a movable vent window supported on rollers for movement along a guideway of the window frame with all four sides engaging the window frame in air and watertight configuration as the vent window finally closes through means of a plurality of wedges engaging the vent window to compress weatherproof sealing insulation.

28 Claims, 16 Drawing Figures

WINDOW AND DOOR CONSTRUCTION

BACKGROUND OF THE INVENTION

There has been great need in the window industry for window construction of the type that secures a movable window sash into an air and water sealed engagement with the outer window frame. Present construction of windows having a movable or slidable vent window for use in residential and commercial buildings attempt to seal the vent window in the window frame by means of placing weatherproofing strips in the vent window frame or in the outer window frame. This type of construction suffers from many problems in that the weatherproofing strips between the window frame and the vent window are constantly engaged which tends to wear the weatherproof stripping as the vent window is operated through a plurality of openings and closings. Further, in present day construction, lightweight aluminum is used in the vent window frame surrounding the vent window pane which engages the weatherproofing strips, or has weatherproofing strips attached to it engaging the window frame, and as a result of the use of lightweight metal, the metal is subject to warping from the constant pressure placed on it by the window frame and weather stripping, regardless of the window position. The tendency then is for the vent window to warp away from the window frame and thus no longer maintain the sealed relationship.

There have also been many attempts in the past to provide sealing means and manners between the frame of the vent window and the window frame, one example being a window construction having cables engaging the periphery of the vent window frame combined with mechanical linkage to seal the vent window frame to the window frame. In addition, there have been other complicated means to seal the vent window to the window frame, as for example shown in Coller, U.S. Pat. No. 3,225,393.

SUMMARY OF THE INVENTION

The present invention comprises a window and door construction having a fixed outer window frame, a fixed window panel within the fixed outer window frame, and a vent window which slides within the outer fixed window frame. This vent window seals against the window construction outer fixed frame in the final portion of its travel as the vent window is placed into a closed position. All descriptions of window constructions apply to door construction also as door construction comprises just larger and stronger components.

The vent window is sealed by means of a plurality of wedges which engage the bottom horizontal piece of the vent window and raise it, whereupon the top and bottom piece of the vent window is engaged by a second series of wedges thereby forcing the window in a horizontal direction at right angles to the direction of travel and airtight and watertight sealing is accomplished. A plurality of jambs also engage both vertical pieces of the vent window and force the window in the same horizontal direction as do the wedges of the top and bottom horizontal pieces whereupon weatherproof sealing insulation is engaged by each end of the vent window.

The vent window is thus sealed about its four sides by compressing weatherproof stripping intermediate the vent window frame and the window construction outer frame. Final placement and locking of the vent window is accomplished through cam-type latch means.

Accordingly, it is an object of the present invention to provide a window construction where a vent window is air and water sealed to an outer window frame.

Another object of the invention is to provide a window construction where the vent window sealing means is engaged in the last portion of the vent window closing travel.

A still further object of this invention is to provide a window construction where the sealing means comprises a plurality of wedges and jamb configurations.

Still another object of the present invention is to provide a window construction having sealing means which are easily adapted from present window construction.

Still another object of the present invention is a window construction providing an easily assembled panel structure which may be formed and installed with a minimum of labor and without requiring special tools.

DESCRIPTION OF THE PREFERRED EMBODIMENT

Figure 1:
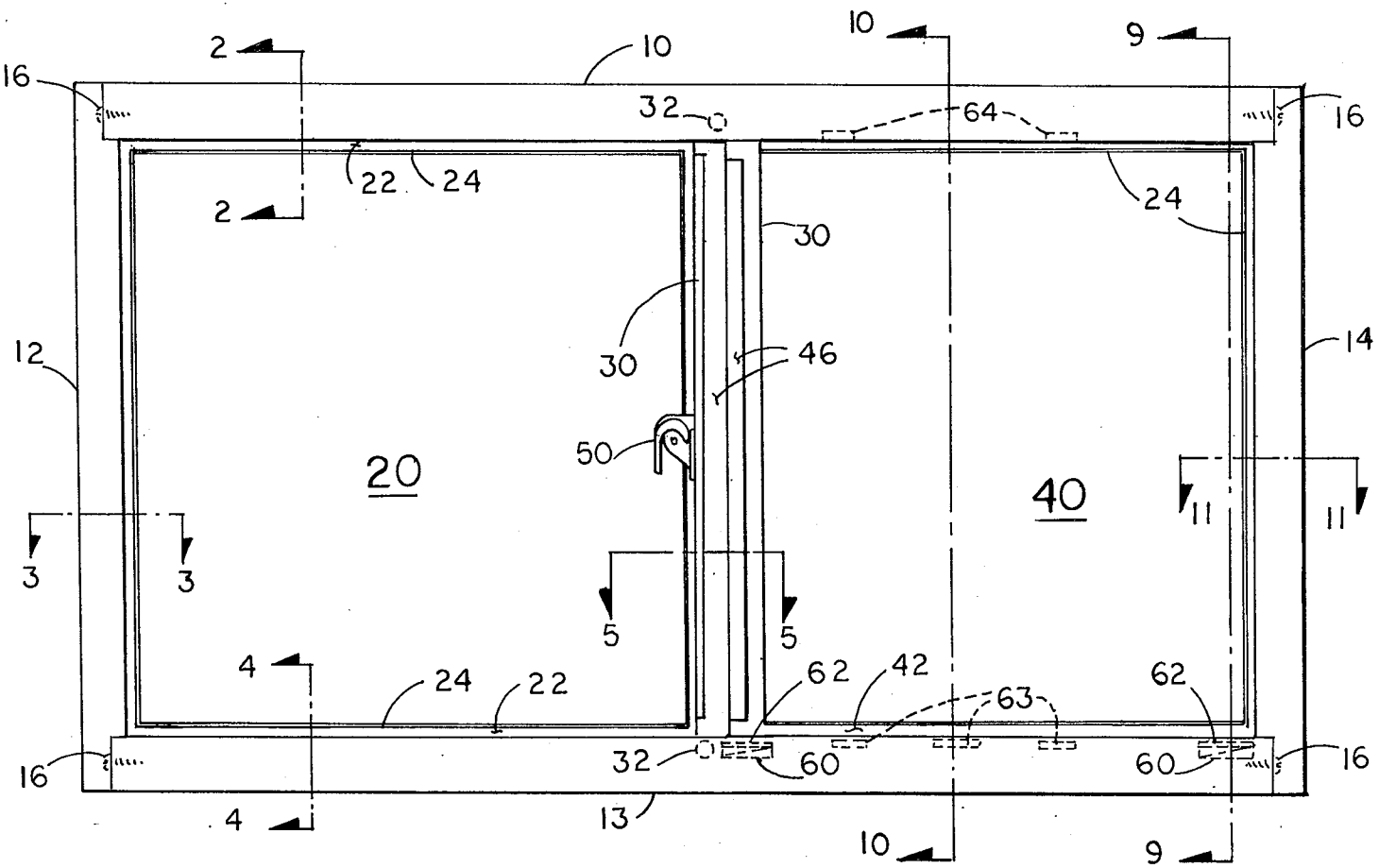
FIG. 1 is a front view of the window construction showing the various components in broad detail.

Referring now to FIG. 1, the embodiment of the invention which provides for window and door construction having a vent window or sliding door which seals upon closing is illustrated. The outer fixed window frame comprises the upper member, head 10; the lower member, sill 13; and the two end members, jamb 12, and jamb 14; and center member, mullion interlocker 30. These members, in the preferred embodiment, are constructed from extruded aluminum having a cross-section hereinafter described. They may however be made of any material which is sufficiently strong and adaptable to the building industry, such as steel or possibly a hard plastic. The five pieces which make up the outer fixed window frame are held together by sheet metal screw means 16 and 32 (shown in dotted form) at the four corners of the frame and at the center of the head and sill. The screw means penetrate the flat central portion of the jamb 12 and 14 with the threads of the screws engaging extruded runways in the head 10 and the sill 13. The outer window fixed frame is adapted to be built into the wall of a residential or commercial building, and is also adaptable to sliding glass doors such as many residences and commercial buildings use in their construction.

Additionally shown in FIG. 1 is fixed panel 20 which comprises a pane of glass central to a metal frame 22 which, together with a sealing grommet 24, surrounds the outer peripheral edge of the pane of glass in a water and airtight configuration. Fixed panel 20 is installed in the outer frame construction and is permanently sealed in place in the outer fixed window frame by means of weatherproof stripping situate between fixed panel frame 22 and the interior perimeter formed by the outer fixed window frame head 10, sill 13, jamb 12, and mullion interlocker 30.

Mullion interlocker 30 is permanently affixed in place between head 10 and sill 13 by means of sheet metal screws 32 (shown in dotted form) engaging the mullion interlocker 30 from the backside of the window construction, which in this case, would be the side facing the outdoors. The front side herein referred to is the interior side which contains the latch means, and from which side the vent window is opened and closed.

Continuing on, vent window 40 is shown in closed configuration, being similarly constructed in relationship to its pane of glass interior to an outer holding frame as is fixed panel 20. More specifically "U" shaped cross-sectional frame means 42 surrounds and holds vent window 40 glass pane by means of sealing grommet 24 in air and watertight configuration. Vent window vertical piece 46, a part of the vent window 42 frame, is so constructed that it completely encompasses the sealing grommet 24 at the periphery of the glass pane of vent window 40. As can be seen from FIG. 1, when the vent window 40 is in the fully closed position, the left hand side of vertical piece 46 lines up with the left side of mullion interlocker 30. It is the alignment of these two sides which permits the caming latch to be installed as described hereinafter. Mullion interlocker 30 is also seen to the right of vertical piece 46 as its width is greater than vertical piece 46.

Latch means 50 permits engaging vertical piece 46 to mullion interlocker 30 and cams vent window 40 to its final closed position through movement of the handle of the latch. Further, the latch disengages vent window 40 from its final resting position to a partially open position through another cam action by raising the handle of the latch.

Additionally shown in FIG. 1 are the plurality of wedges (in dotted form) which engage vent window 40 to urge it into its final sealed position. More specifically, sill wedges 62 (shown in dotted form) reside interiorly to sill 13 upon a sill track which will be discussed later. Vent window 40, which has rollers situate in the bottom of frame 42, rides upon the sill track and up on the wedges 62 as vent window 40 rides into its final resting position. This has the effect of lifting vent window 40 by the height of the wedges, normally small in comparison to the total height of the window. Wedges 62 have a plurality of wedge surfaces which, in addition to raising the vent window 40, also have an inclined surface wedge in a vertical plane which is engaged by tabs upon the bottom of vent window 40 to urge vent window 40 in a horizontal direction and thereby engage inner walls contained within head 10 and sill 13 of the outer window construction frame. Additionally, in head 10 of the outer fixed window construction, there is a wedge which has been formed in the metal of the head. This wedge is engaged by tabs attached to vent window 40 upper member of frame 42 when vent window 40 is lifted by wedges 62 attached to sill 13. This urges vent window 40 horizontally.

Also, wedge 63 (shown in dotted form) located within sill 13 is similar to wedges 62 except it only has one wedge surface which is located in the vertical plane in order that it may urge over vent window 40. In practice, the aforementioned tabs attached to the upper piece of frame 42 run under wedges 63 and the formed head wedge, engaging these wedges only when the vent window 40 is lifted by its rollers engaging rising wedges 62. Thus vent window 40 frame 42 is, upon its top and bottom sides, urged against interior walls of the sill 13 and head 10 which, when combined with weatherproof stripping attached to frame 42, places head 10 and sill 13 and vent window 40 frame 42 in sealed relationship. The remaining two sides of vent window 40 are also sealed as described below.

To seal vent window 40 to the vertical jamb 14 of the window outer frame construction, the far right hand side piece or jamb stile of the vent window frame 42 engages jamb 14 in a widening wedge type configuration which, when utilizing weatherproof stripping upon the jamb stile, seals the combination from water or air passage. Similarly, the vertical piece 46 engages the mullion interlocker 30 in a widening wedge type configuration providing the necessary water and air sealing through a compression of weatherproof stripping.

It is noted that the vent window, in its final inch or so of closing, is lifted up and pushed over, i.e., when viewing the drawing of FIG. 1, it will be pushed away from the viewer along all four sides of the window. All of the interlocking pieces and movement of the vent window, together with the construction of specific pieces forming the outer window frame, and the vent window construction, are more clearly shown in the plurality of cross-sectional views which will be described in subsequent figures.

Figure 2:
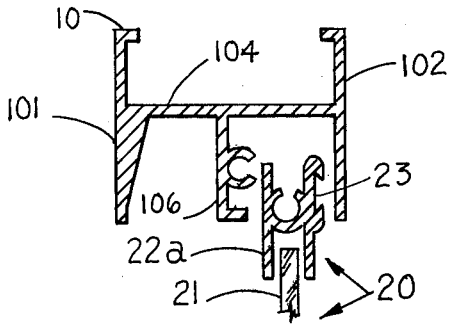
FIG. 2 is a cross-sectional view taken along sectional lines 2—2 of FIG. 1.

Referring now to FIG. 2, which is a cross-sectional view taken at sectional line 2—2 in the fixed panel portion of the window construction, the relationship of the fixed panel 20 to the outer fixed frame head 10 can be seen. More specifically, head 10 comprises basically an "H" shaped piece of durable material, nominally extruded aluminum, having side walls 101 and 102, flat central portion 104 is interposed the two walls, with bottom half of the "H" shaped structure being divided into essentially two inverted "U" shaped channels by the wall 106, the first channel formed by walls 101, 106 and 104, and adapted to receive vent window 40 and frame 42; and second inverted "U" shaped channel formed by walls 102, 106, and 104, and adapted to hold fixed panel 20 in a sealed configuration. Fixed panel 20 comprises upper frame member **22*a* and glass, or other material, window pane 21. Upper frame member 22*a*, which is generally constructed from a resilient and relatively durable material such as extruded aluminum, has slot 23, which runs along the length of member 22***a* and is adapted to receive weatherproof stripping which is held in place by the inward sloping walls of the slot. The weatherproof stripping (not shown) firmly affixed to upper frame member 22*a*, engages the interior side of side wall 102 of the head 10 in a compression configuration. The weatherproof stripping may be made of vinyl plastic, rubber, or any other suitable type of weatherproof stripping as many types are available commercially. The weatherproof stripping interposed frame member 22*a* and side wall 102 of head 10 pushes upper frame member 22*a* against the central dividing wall 106 of head 10 where it rests.

With particular attention to the central portion of frame member 22*a*, it is noted that there resides a somewhat round linear cavity, not a completed circle though, which is adapted to receive a sheet metal screw at the ends of the upper frame member 22*a* for the purpose of fastening the sides of the fixed panel frame 22 together. When the fixed panel 20 is being assembled, sheet metal screws join the vertical portions of the panel with the top and the bottom portions completely enclosing the glass window pane 21 at its periphery. Similarly, it can be noted that wall 106 which divides the lower portion of "H" shaped head 10 into the two channels similarly comprises a three-quarter moon type configuration which, like that shown in upper frame member 22*a*, is adapted to receive a sheet metal screw at its ends to permit the joining of the two end vertical members, jambs 12 and 14, to form the outer fixed frame. With reference to FIG. 1, screws 16, which engage the interior of these cavities, may be seen.

In installation of the invention into a residence or commercial building, the outer frame construction is placed in the opening in the wall designed to receive it and the building construction materials are placed in the outer channel formed in the perimeter of the fixed outer window frame to seal the frame in place and to make airtight. It is noted that there is space above upper frame member 22*a* (FIG. 2) as it resides in the channel formed by walls 102, 104, and 106 of head 10. This space, or cavity, permits the fixed window panel 20 to be lifted up until the bottom portion of fixed window frame 22 clears the sill wall which, after mullion interlocker 30 (FIG. 1) has been moved aside through use of a slotted hole in head 10 and sill 13, permits fixed window panel 20 to be removed from the outer window frame. Installation of fixed window panel 20 is accomplished by reversing the steps above. This permits the fixed panel 20 to be installed after the outer frame has been built into a building, and permits replacement of the fixed panel in case of breakage of the window pane.

Figure 6:
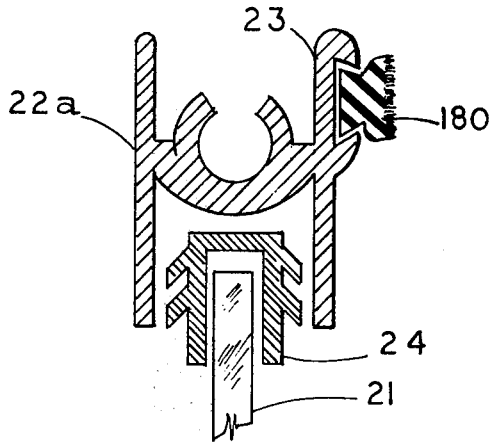
FIG. 6 is an expanded cross-sectional view of the fixed window panel frame taken at sectional line 2—2 of FIG. 1.

It should be noted in FIG. 2 that interposed the upper frame member 22*a* and glass window pane 21 is a sealing means which accomplishes the purpose of holding glass window pane 21 firmly in upper frame member 22*a* while at the same time insuring that no air or water may pass between the two members such as to penetrate the interior of the house or building. FIG. 6 shows a typical installation of the window pane sealing material grommet 24 together with the weatherproofing sealing material 180 held in slot 23 of upper frame member 22*a* in fixed panel 20. The weatherproof sealing material 180 is adapted to slide into slot 23 formed in upper frame member 22*a* and which is held in compression against side wall 102 during final closing. Window pane sealing material grommet 24 is similarly rubber of vinyl plastic which encompasses the perimeter of window pane 21, about which upper frame member 22*a* encompasses, in tight fitting relationship. It is noted that window pane sealing material grommet 24 has a plurality of linear extensions emanating therefrom which lay over as the window pane and sealing material is pushed into place in the channel formed in frame member 22*a* but, upon attempted withdrawal of window pane 21, will roll upon themselves and resist removal. The effect, as is obvious, is to render the combination window pane and fixed frame member a waterproof, airtight structure.

Figure 3:
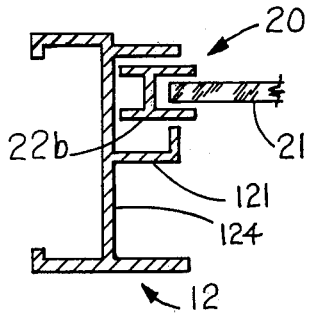
FIG. 3 is a cross-sectional view taken along sectional line 3—3 of FIG. 1.

Refer now to FIG. 3 where is shown a cross-section view taken at sectional line 3—3 of FIG. 1. Again shown is jamb 12 which comprises a basic "H" cross-sectional shaped member, made of a durable, resilient material, nominally extruded aluminum, with a central member 121 rising from the flat central portion 124 of the "H" shaped jamb. Again note that fixed panel 20 resides within one of the two channels formed in the upper portion of jamb 12 by central member 121. Referring specifically to fixed panel 20, it is noted that the fixed panel frame 22 vertical frame member 22*b* has a configuration different than upper frame member 22*a*. Vertical frame member 22*b* is held in fixed relationship to jamb 12 by means of weatherproof sealing material 126 which is held in compression between the end of vertical frame member 22*b* and jamb 12 (see FIG. 7). With specific reference to FIGS. 3 and 7, the air and water sealing type construction is shown which is employed between the glass window pane 21 and vertical frame member 22*b*, namely window pane sealing material grommet 24 which has been described in connection with FIG. 6. As in the description of FIG. 6, a weatherproof sealing material 126 is installed within the channel formed in vertical frame member 22*b* which is held in compression between vertical frame member 22*b* and jamb 12. This material is similar to the similarly named material of FIG. 6, however, it is of a different shape as it is adapted to nest in a different shaped channel. Thus vertical frame member 22*b* is held in a watertight, relatively airtight relationship within jamb 12. As also can be seen in FIG. 3, the outside portion of jamb 12 is similarly channel constructed as is the top portion of head 10 (FIG. 2) permitting construction of the building materials into the outer fixed frame perimeter. There are also ears at the outside portions of the sides which form the "H" to hold the construction materials as is in all exterior pieces of the outer fixed window frame. It is noted that there are no three-quarter moon shaped channels or runways running lengthwise through jamb 12 as a review of FIG. 1 shows that the screws 16 penetrate the flat central portion 124 of jamb 12 to engage the sheet metal screw receiving means already described in head means 10 of FIG. 2.

Figure 4:
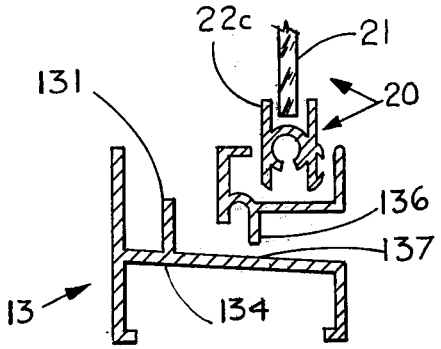
FIG. 4 is a cross-sectional view taken along sectional line 4—4 of FIG. 1.

Referring now to FIG. 4, a cross-sectional view taken at sectional line 4—4 of FIG. 1 is shown and illustrated. Fixed panel 20 is shown in position in FIG. 4 which, as can be seen, has lower frame member 22*c* the same, in cross-section, as the upper frame member 22*a* (FIG. 2). Similarly, the sealing means employed in fixed window panel 20 between window pane 21 and the frame member sill 13, together with the weatherproof sealing material has already been described above with reference to FIG. 6.

As has been the case with the other outer window construction members, the sill 13, in that portion which does not engage the building, is divided into two basic lengthwise channels, one to receive the fixed panel 20 and the other to receive the vent window 40. Here, a sill track 131 is provided for vent window 40 to roll upon. As will be described later, vent window 40 has a plurality of rollers located in its bottom frame members, which rollers engage and ride upon sill track 131.

In FIG. 4, flat central portion 134, which comprises the crossmember of the "H" shaped sill 13, is slanted to the right a slight amount. The purpose for this is to permit water, which may collect in sill 13, to run to the outside of the building, and to this end, weep holes 137 are cut or drilled through upright member 136 which permits water collected in the channel in which the vent window 40 resides, to drain across flat central portion 134 to the outside. Bifurcated upright member 136 forms a channel between its fingers to contain fixed panel 20, and one finger provides a semicircular runway to receive the sheet metal screws which hold the outer frame construction together and part of a channel in sill 13 to receive the vent window 40 riding upon sill track 131.

It should be noted that in the members described above, namely head 10 and sill 13, each have in their cross-section throughout their entire length, a channel adapted to receive fixed panel 20, and vent window 40. The sill 13 in the channel, adapted to receive the vent window, has a sill track along its entire length and vent window 40 is free to move along the entire length. The channel receiving fixed panel 20 is blocked off in the center by mullion interlocker 30.

Figure 5:
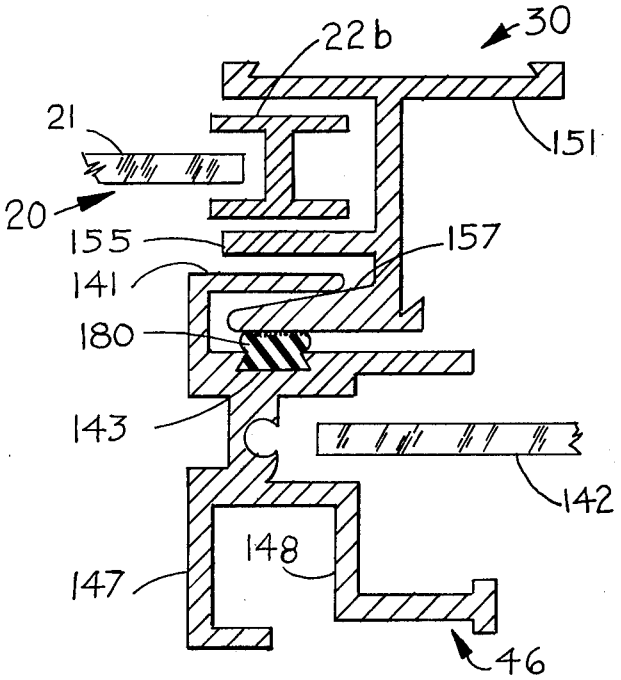
FIG. 5 is a cross-sectional view taken along sectional line 5—5 of FIG. 1.
Figure 7:
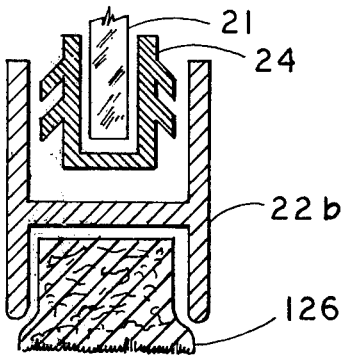
FIG. 7 is an expanded cross-sectional view of the vent window as taken along sectional line 5—5 of FIG. 1.

Referring now to FIG. 5, a cross-sectional view is shown taken at sectional line 5—5 of FIG. 1 showing mullion interlocker 30, vent window 40 vertical piece 46, and the fixed panel frame member **22*d*. It can be seen that the two members, mullion interlocker 30 and vertical piece 46, engage each other in an interlocking finger type arrangement. In FIG. 5, the mullion interlocker 30 on the right-hand portion of the figure has somewhat of a chair type configuration comprising a flat elongated side wall 151 with centrally outstanding member 153 forming the seat of the chair, together with a plurality of spaced-apart legs 155 and 157 extending at right angles to the outstanding member 153. Fixed panel 20 resides within the channel formed by side wall 151, member 153 and leg 155. It is noted that the fixed panel 20 frame member shown in FIG. 5 has the same cross-section as its opposite as shown in cross-sectional view FIG. 3. Also, similarly as shown in FIG. 7, window pane sealing material grommet is interposed the window pane 21 and the fixed panel frame 22 as well as the weatherproof sealing material interposed the fixed panel frame 22*d* and mullion interlocker 30**.

Vertical piece 46 of vent window 40 is shown in FIG. 5 having a knuckle or tongue 141 which moves in the elongated groove formed by leg 155 and tapered leg wedge 157 of the mullion interlocker 30. As it can be seen, as tongue 141 engages tapered leg wedge 157, vertical piece 46 is urged toward fixed mullion interlocker 30 and threby compresses weatherproof sealing material 180 to effect the air and watertight seal between the vent window (through vertical piece 46) and the mullion interlocker 30. Weatherproof sealing material 180 fits into slot 143 formed in vertical piece 46.

Thus as can be seen, fixed panel 20 is set into mullion interlocker 30 in a waterproof and relatively airtight configuration while vent window 40 is also set into mullion interlocker 30 in the same type of configuration.

Figure 8:
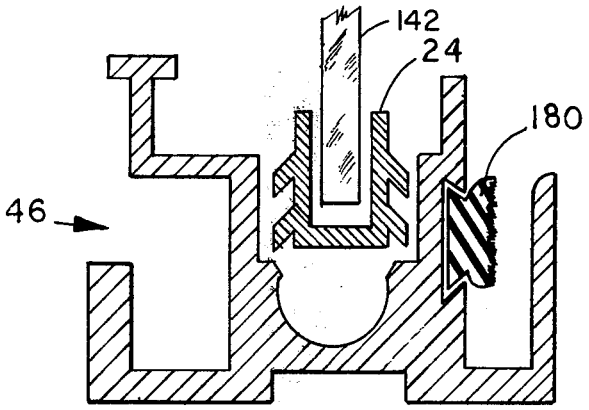
FIG. 8 is an expanded cross-sectional view of the vent window vertical piece as taken along sectional line 5—5 of FIG. 1.

Referring briefly to FIG. 8, window pane 21 is set into the groove formed in vertical piece 46, there being the window pane sealing material grommet 24 interposed the two. At the bottom of the channel formed for pane 21 is a cavity taking the appearance of a three-quarter moon which, as has been discussed in the case of head 10 and sill 13, receives a sheet metal screw holding together the vent window frame which surrounds vent window pane 21.

Continuing on with FIG. 5, vertical piece 46 has a pair of extensions at right angles to the portion forming a part of the vent window pane receiving channel, which right angle extensions 147 and 148 have additional pieces attached to them for the purpose of, among others, holding while sliding the window back and forth. Of course latch means 50 (FIG. 1) may be used to slide the window back and forth also, but its primary use is to finally latch the window.

Referring again briefly to FIG. 8, an expanded cross-sectional view of vertical piece 46, the weatherproof sealing material 180 interposed between vertical piece 46 and mullion interlocker 30 is, in addition to grommet 24, shown in broad detail.

Figure 9:
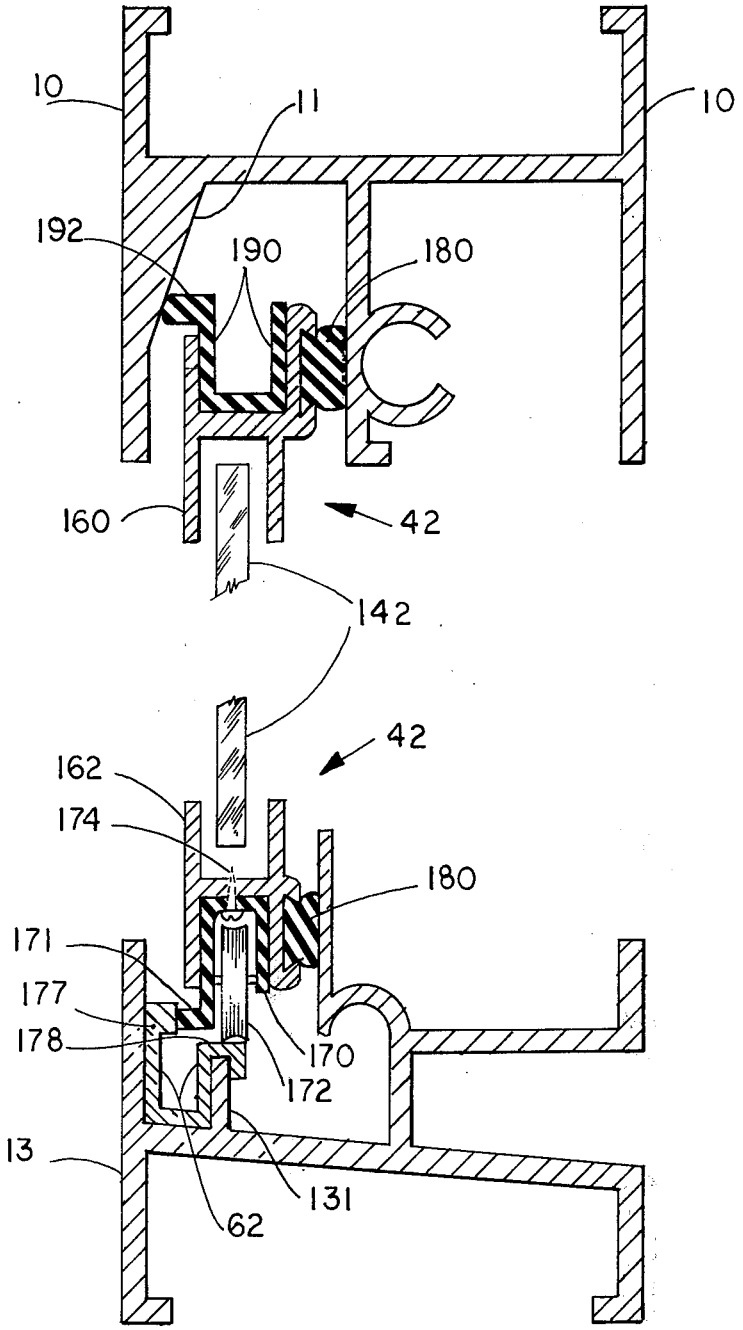
FIG. 9 is a cross-sectional view taken along sectional line 9—9 of FIG. 1.

Referring now to FIG. 9, a cross-sectional view taken at sectional lines 9—9 on FIG. 1 is shown detailing the wedge mechanisms that raise vent window 40 to engage other wedges which push vent window 40 into a sealing configuration. More specifically, a cross-sectional view of head 10 and sill 13 are illustrated with vent window 40 shown in the fully closed sealing position. Additionally shown is the vent window frame 42 which comprises in part, top member 160 and lower member 162 which are similarly constructed pieces of extruded aluminum or other durable material. Generally, members 160 and 162 comprise an "H" shaped structure having a slot to receive weatherproofing strip cut into one of the legs. Looking now at lower member 162, wedge insert 170 is shown nesting in the lower "U" shaped channel formed in lower member 162 opposite the window pane 142. This wedge insert, also generally in the shape of a "U" conforming to the channel in which it resides, is nominally made of nylon or teflon or other suitable material, including plastics and metals. It contains, in the three-quarter cavity formed by the "U" shape, roller 172. Roller 172 is supported by an axle fixed in the sides of the channel of wedge insert 170. Roller 172, for most of its travel, runs on sill track 131 which continues throughout the whole length of sill 13. Roller 172 is slightly concave at its periphery in order to remain more easily upon sill track 131. Wedge insert 170, nominally about an inch to an inch and a half in length, is secured within the channel of vent window frame 42 lower member 162 by sheet metal screw means 174. Nominally, two screws are placed in wedge insert 170, one at each end. The roller is positioned approximately midway between the ends of wedge insert 170.

Sill wedge 62 encompasses sill track 131 and thereby provides the means by which vent window 40 is raised into position to be air and water sealed. However, only in the final inch or so of vent window 40 travel does roller 172 engage sill wedge 62. Sill wedge 62 fits within the channel formed by sill track 131 and the wall of sill 13 which is interior to the house or building which utilizes the invention. Sill wedge 62 has two wedging surfaces, the first being sill track wedge surface 178 beginning at a point joining the top of sill track 131 and increasing in height in the direction of vent window 40 closing. Roller 172, which rides along sill track 131, engages sill track wedge surface 178, rides up on the surface and thereby forces vent window 40 upwards. As can be seen from FIG. 1, sill wedge 62 is placed in at least two strategic positions with respect to wedge insert 170, of wich of course, there are also at least two. Two wedge inserts 170 rollers 172 engage, simultaneously, at least two sill wedges 62 placed in sill 13 corresponding to wedge inserts 170 at each bottom end of vent window 40. Thus lower member 162 of the vent window frame 42 is raised at each end so that the window rises while its horizontal members remain horizontal with respect to the vertical. As roller 172 engages sill track wedge surface 178 and begins its upward rise, tab 171 of wedge insert 170 engages sealing wedge surface 177 which, starting out from a thickness of essentially zero, progressively builds up and, as tab 171 traverses the wedge surface, forces vent window 40 over to the outside (from the inside of the building) and places the lower member 162 weatherproof sealing strip 180 against sill 13 inner wall.

It is noted that wedge insert 170 tab 171 relationship with sealing wedge surface 177 portion of sill wedge 62 is such that the tab 171 would ride beneath sealing wedge surface 177 when roller 172 directly engages sill track 131. Only when vent window 40 is elevated would tab 171 of wedge insert 170 engage sealing wedge surface 177. It is noted that roller 172 shown in FIG. 9 is no longer in line with sill track 131, but has in fact been urged over from sill track 131, although it is still upon sill track wedge surface 178.

Sill wedge 62 is held in place in sill 13 by means of an adhesive, or if desired, screw means such as those used to hold wedge insert 170 may be utilized. In the preferred embodiment two sill wedges are utilized in each window construction located such as to be engaged by two wedge inserts 170. Since the wedge surfaces of sill wedge 62 end abruptly at the wedge surfaces' greatest elevation, it is obvious that only two sill wedges may be employed as the roller 172 could not travel over the abrupt edge as vent window 40 were being opened. Thus, the left-hand wedge 62 limits the travel of the right-hand wedge insert 170 which, in practical terms, means vent window opens about 90 percent when the mullion interlocker halves the outer fixed frame construction. Therefore, it is necessary that the sill wedge placement within sill 13 and the wedge insert 170 placement within vent window frame 42 lower member 162 be such that the vent window 40, in its position of maximum closing, not permit roller 172 to go beyond the edge of the sill wedge 62. This, in actual practicality, is not a difficult feat as window travel is known, and it is in the last inch or so of travel that the sill wedge 62 is engaged, and the wedge is generally an inch or so long. All of these dimensions can change of course, but the placement becomes more critical as the pieces are made smaller. Obviously also, sill wedge 62 placement relative to wedge insert 170 must be considered in view of the desired horizontal movement of vent window 40 lower member 162 sought as the sealing relationship with sill 13 is a function of the amount of compression exerted against weatherproof sealing material 180 by the adjoining members.

Referring now to the upper portion of FIG. 9, top member 160 of vent window frame 42 of the vent window is shown in fully closed configuration. Here upper wedge insert 190 nests interiorly to a channel formed in top member 160 opposite window pane 142. Tab 192 of upper wedge insert 190 engages tapered leg wedge 11 of head 10 only when vent window 40 has been raised by virtue of roller 172 movement up the incline of sill track wedge surface 178 on bottom sill 13. Tapered leg wedge 11, like sill wedge 62, presents an inclined surface to tab 192 only when vent window 40 has been raised. Tapered leg 11, formed in head 10, runs the whole length of head 10, and is located such that tab 192 of upper wedge insert 190 rides underneath the incline when roller 172 is riding on sill track 131. Thus, by referring to FIG. 1, it is apparent that there may be more than one upper wedge insert as this wedge is not engaged except at the time when vent window 40 is raised. There are, in the preferred embodiment, at least two upper wedge inserts 190. Again, as top member 160 is urged horizontally by the tapered leg 11 (at the time that the window is being closed), the engagement of insulation weatherproofing strip 180 against head 10 wall is compelled and thus forms the upper seal against the passage of air and water into the house or building.

It is apparent from the above discussion of FIG. 9 that vent window frame 42 has been sealed along its top member 160 and its lower member 162 through coaction of insulation weatherproofing strip 180 in both top and lower members and the head 10 and sill 13 respectively. The sealing has been accomplished at at least two pressure points on the lower member. Since the top member and the lower member have rigidity, the insulation weatherproofing strip 180 continues their whole length, and the head 10 and sill 13 also continue the whole length, we now have two sealed lengths over the top and bottom portions of vent window 40.

Figure 10:
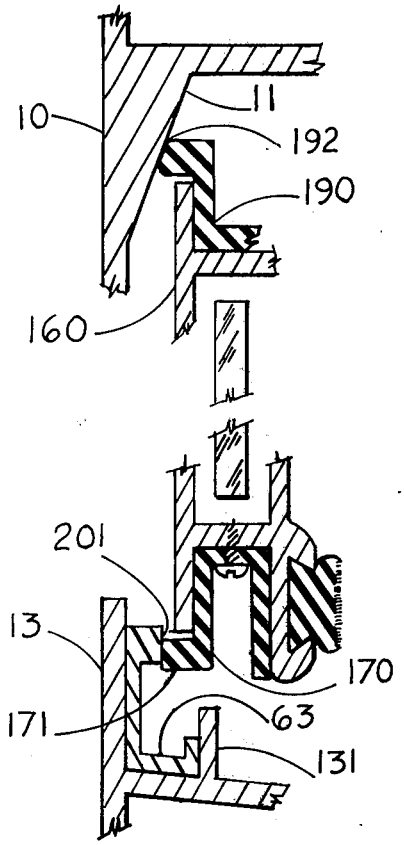
FIG. 10 is a cross-sectional view taken along sectional line 10—10 of FIG. 1.

As a practical matter, there is some flex in the lower member 162 of vent window frame 42 and it has been found helpful to add one or more modified wedge inserts together with a modified sill wedge on the bottom sill. More specifically, a cross-sectional view at 10—10 of FIG. 1 is illustrated in pertinent part in FIG. 10. In FIG. 10, the same tapered leg wedge 11 is engaged by the same tab 192 of upper wedge insert 190. Thus there is no change in part or in construction of the means of sealing vent window 40 to head 10. However, referring to the lower portion of FIG. 10 it can be seen that there has been considerable modification to the means for bottom sealing the vent window. Intermediate sill wedge 63 has only one wedge incline plane surface 201, and that the wedge surface of wedge 62 which formerly sat on top of sill wedge 131, has been removed. Thus, as discussed above, all abruptly ending wedge surfaces upon sill track 131 have been removed and no obstacles are presented to roller 172 shown in FIG. 9. Roller 172 would pass through the area shown at 10—10 of FIG. 1 when the vent window 40 was travelling to its furthest open position.

Note also that modified wedge insert 170, now changed to remove the centrally located roller, still engages through tab 171 incline plane wedge surface 201 when, and only when, vent window 40 has been raised. The drawing shown in FIG. 10 is a cross-sectional view of the window construction with the vent window 40 in its closed position, and thus its position as a result of being raised by sill wedges 62 at each end. Again, as is evident from FIG. 9 and FIG. 10, when the vent window 40 is disengaged and slid to its open position, tab 171 of wedge insert 170 shown in FIG. 9 will ride under the incline plane wedge surface 201 of intermediate sill wedge 63.

Similarly, if there are more than one intermediate wedge combinations between the two wedge means at the ends of the lower member 162, the tab to the wedge inserts of lower member 162 will ride under the incline plane wedge surface 201 of all intermediate wedges. Thus it can be seen that the engagement of tabs on the wedge inserts of lower member 162 is only when vent window 40 has been raised. As many intermediate wedge combinations may be placed in the head and sill of this window construction as is determined necessary. This depends on the strength and rigidity of the members which comprise the vent window and, to some extent, the rigidity of the head 10 and the sill 13.

Figure 11:
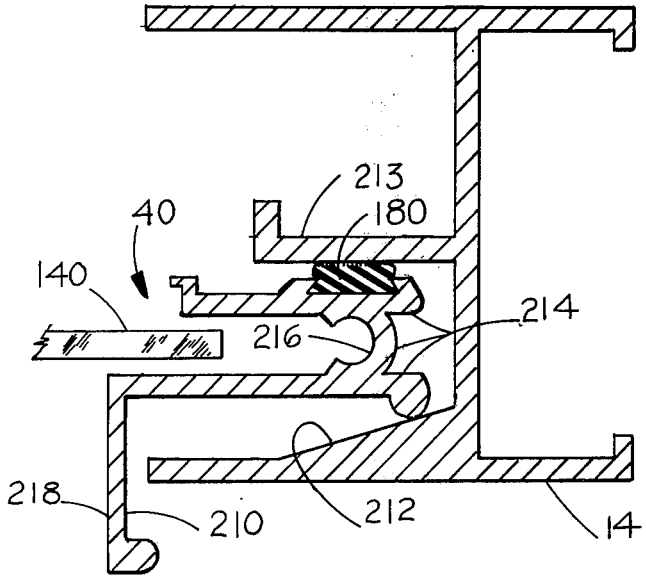
FIG. 11 is an expanded cross-sectional view taken along sectional line 11—11 of FIG. 1.

Referring now to FIG. 11, a cross-sectional view of the end portion of the window construction taken along sectional line 11—11 of FIG. 1 when the vent window 40 is fully closed is shown.

Jamb 14, it is first noted, has one of its walls tapered inward, done by increasing the thickness of the metal in the "U" shaped channels adapted to receive the vent window members. The vent window frame 42 end piece is termed the jamb stile 210. It comprises one piece of metal or other resilient durable material, nominally extruded aluminum which, like the other members of the vent window frame 42, forms a portion of the perimeter of the vent window construction surrounding the pane of glass. The wedge shaped wall portion 212 of jamb 14 is engaged by jamb stile 210 leading knuckle edge as the vent window is closed, in turn forcing jamb stile 210 toward wall 213 formed in jamb 14 opposite wedge shaped portion 212, and thereby compressing the insulation weatherproofing strip 180 effecting the air and watertight seal. It is to be noted that in the last portion of the longitudinal travel of the vent window 40, the vent window is urged in a direction to compress the insulation weatherproofing strip. The vent window moves in the same horizontal direction along all four sides forming the perimeter. This prevents the window from becoming warped by one side being held in a fixed position while the others are urged to another position.

It is noted that in the construction shown in FIG. 11, it would be entirely possible to place strip insulation in the channel 214 formed opposite the window pane and the insulation could either supplement weatherproof sealing material 180 or take its place completely. Also shown in jamb stile 210 is the sheet metal screw receiving circular shaped channel 216 which permits the mechanical fastening together of the top and bottom portions of the vent window frame 42 components. Again, window pane 142 is held in place by rubber or other grommet means in the fashion shown in FIGS. 6 through 8.

Figure 13:
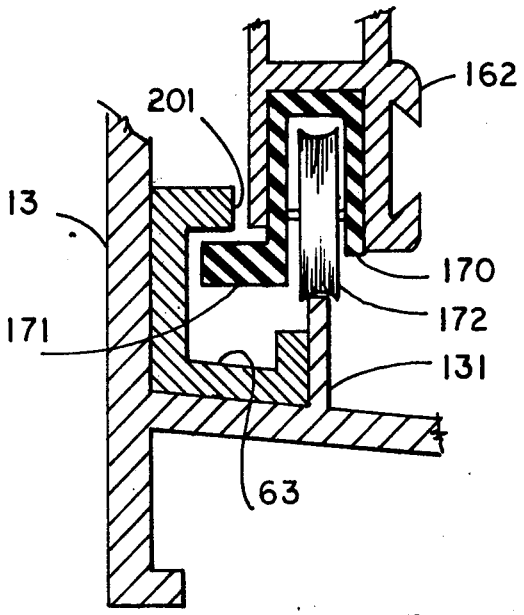
FIG. 13 is an expanded cross-sectional view taken at the intermediate sill wedge as the vent window is partially opened.

Additionally, jamb stile 210 comprises handle means 218 for a person to hold onto when opening or closing the window vent. There are three ways of opening and closing the vent window 40 during the majority of the portion of its travel and those are the handle means 218 shown in FIG. 11, the handle means 148 and 147 shown in FIG. 5, or the latch means which is shown in FIG. 1 and FIG. 13 hereinafter . The last bit of travel of the vent window 40 is accomplished best by utilizing the latch mechanism which secures the window to a final resting position and assures that all sealing surfaces have engaged. During construction of the invention, all wedges and other mechanisms already described are aligned such as to produce sealing at all points.

Figure 12:
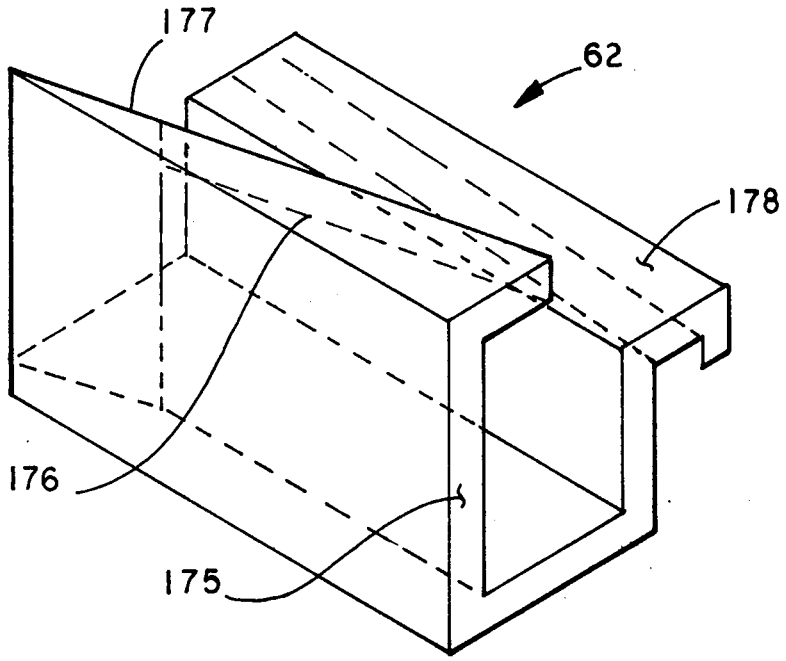
FIG. 12 is a perspective view of the sill wedge.

Proceeding on to FIG. 12, a perspective view of the sill wedges 62 is shown. In order to facilitate the manufacture of this subject invention, it is suggested that sill wedge 62 be one piece, adapted to fit over sill track 131 (as shown in FIG. 4), and nest in the channel formed between sill track 131 and the outside wall. As had been stated earlier, it is preferred that wedge 62 be held in place with an adhesive, although a sheet metal screw could be used to hold the wedge to the metal forming the sill 13.

More specifically, sill wedge 62 provides two inclined surfaces, the first being sill track wedge surface 178 which starts at one end of sill wedge 62 and runs to the opposite edge, the surface starting with an essentially zero thickness at the sill track and rising evenly and gradually to its maximum height at the other end of sill wedge 62. It is upon this surface that the roller, a part of wedge insert 170 which fits into the lower member of vent window 40, shall ride upon and, as explained earlier, will no longer follow the sill track trajectory as it is being urged over to the side by coaction of the other wedge surface shown in FIG. 12. Therefore, the surface is flat and does not provide a track for the roller. The roller is shown in FIG. 9.

The second wedge surface is sealing wedge surface 177, where as seen in FIG. 12, only the edge is visible. Similarly, as with the sill track wedge surface 178, the sealing wedge surface 177 starts at a point having essentially zero thickness and then builds up to its point of maximum thickness at the opposite end of the wedge. Both wedge surfaces build up to their maximum thickness at the same end of the wedge. Note that the wall 175 of sill wedge 62 which supports sealing wedge surface 177 also is tapered where it joins the sealing wedge surface 177. In the preferred embodiment, sill wedge 62 is made from an extruded plastic material, teflon, or other similar material. Of course metal, or any hard durable material, would also suffice.

The relationship of the height of sealing wedge surface 177 (and more particularly, bottom edge 176 of surface 177) to the sill track 131 (FIG. 9) and sill track wedge surface 178, is such that the tab 171 of the wedge insert 170 situate in lower member 162 of the vent window (FIG. 9) engages fully the sealing wedge surface 177 as the roller attached to wedge insert 170 raises the vent window up. Thus, the height of the sealing wedge surface edge 176 is above the maximum height of the sill track wedge surface 178. Otherwise the tab 171 would not pass under sealing wedge surface 177 when the roller engages sill track 131.

Reference now to FIG. 10 where the modified sill wedge 63 is illustrated in cross-section, shows that the only change that has been made to sill wedge 62 shown in FIG. 12 is to remove the portion of sill wedge 62 which encompasses sill track 131, i.e., that portion relating to the sill track wedge surface 178. In actual practice a new sill wedge 63 (FIG. 10) is manufactured having its wall only engaging the side of sill track 131. The portion of the intermediate sill wedge 63 as shown in FIG. 10 engaging the side of sill track 131 must have a height which is less than sill track 131 such that the overhang in concave shape roller 172 does not touch it.

In order to more completely understand the invention, FIG. 13 illustrates the situation when the far right side of the vent window (FIG. 1) passes the intermediate sill wedge as the vent window is opened. Here, tab 171 of wedge insert 170 passes under sealing surface 201 of modified sill wedge 63. As is plain, roller 172 is riding upon sill track 131 and tab 171 does not engage the sealing surface 201.

Figure 14:
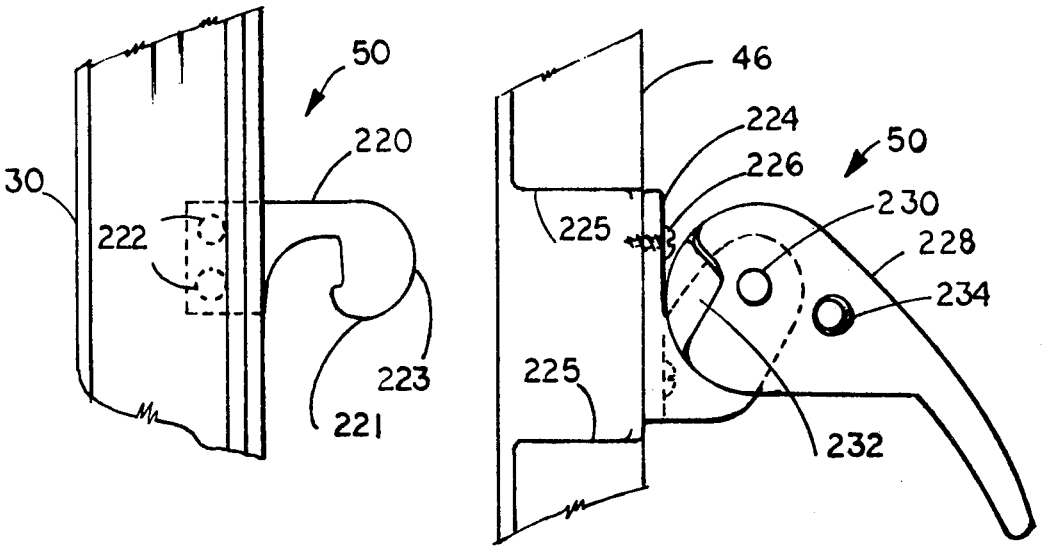
FIG. 14 is a perspective view of the latch assembly.

The last remaining structure of the preferred embodiment of the invention herein is the latch mechanism which is shown in detail in FIG. 14.

FIG. 14 illustrates the mechanism of the latch which performs the dual function of securing the vent window 40 into its final resting place and starting the opening of the window from its locked position. More specifically, the mullion interlocker 30 is shown having attached to it the receiving hook shaped catch 220 (this view shown here is as seen from the outside of the building looking inward and the vent window has been opened an amount sufficient to show the latch mechanism 50). Catch 220 is held by rivets 222 (shown in dotted form). With reference to FIG. 5, it can be seen that catch 220 fits into the modified "U" shaped channel formed by tapered leg 157 and wall 155. The rivets shown pass through tapered leg 157 to the outside of mullion interlocker 30 exterior wall.

The handle 228 of latch mechanism 50 is attached to vent window 40 vertical piece 46 through an "L" shaped leg 224 attached to vertical piece 46 by sheet metal screw means 226. Handle 228 is pivotally secured to the outstanding portion of "L" shaped leg 224 by axle or pin means 230, about which handle 228 rotates.

As a part of handle 228, lug 232 is located at the end opposite the hand holding portion, with round pin 234 across from lug 232 through axle means 230. It is noted that on vertical piece 46, a portion 225 of finger 155 (see FIG. 5), has been cut away to permit catch 220 to slide in the cavity formed thereby.

The latch mechanim 50 is engaged as follows: vent window 40 is closed by hand, either by grabbing handle 228 or the portions which protrude from each of its vertical ends, to the point where it just begins to engage the vertical rising wedges located on sill track 131 of sill 13. Handle 228 on vertical piece 46 is raised to a point where it is horizontal with the ground and lug 232 may pass underneath tip 221 of catch 220. Then after lug 232 has just cleared tip 221, handle 228 is pushed down causing the top edge of lug 232 to engage the interior hook portion of catch 220 which upon continued pushing down of handle 228 urges vent window 40 into its securing position, i.e., riding up on sill track wedges and being pushed over by the upper and lower sealing wedges, together with engaging the tapered portions of the two vertical end pieces of the window construction. When the handle has been pushed to a position where it is substantially vertical, the window is fully seated and lug 232 nests within the cavity formed by the hook of catch 220.

Thereafter, to disengage vent window 40 from its closed position, handle 228 is raised until it reaches a point which is approximately horizontal. At that point, lug 232 has rotated out of interior of the hook formed in catch 220 and round pin 234 has engaged the back portion 223 of catch 220, whereupon with continued lifting of handle 228, pin 234 slides up back portion 223 of catch 220 and, through lever action of pivotal pin 230 and round pin 234, retracts vent window 40 to a position where it is substantially no longer engaging the wedges, both vertical and horizontal, and the vent window may easily be opened by hand. It is realized of course that while the latch mechanism 50 was installed for final closing and opening of the sliding vent window, the invention will still work without the latch mechanism, it only requiring more effort on the part of the operator to finally close the window and the open the window.

Applicant suggests that there are alternate embodiments related to this invention, which applicant describes as follows.

Figure 15:
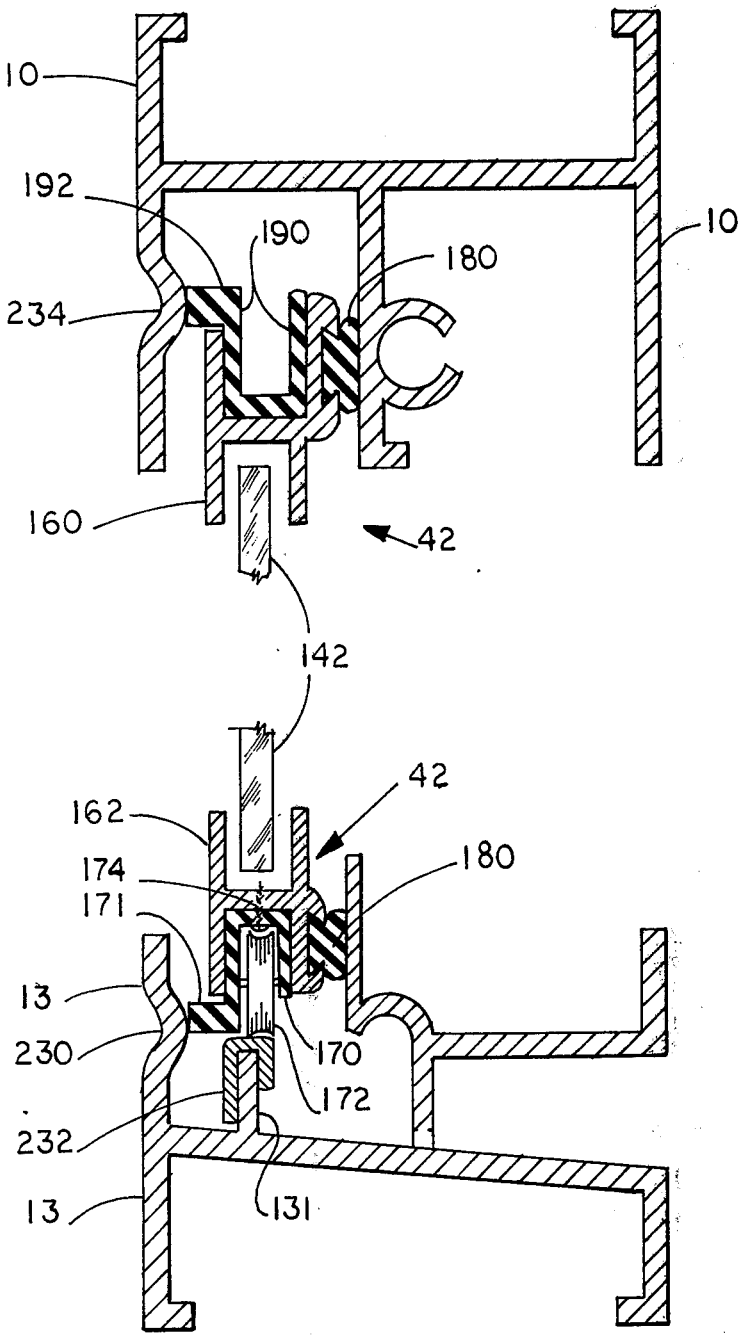
FIG. 15 is a cross-sectional view taken at sectional line 9—9 of FIG. 1 of the alternate embodiment.

For example, an alternate embodiment could be utilizing by deforming the metal of the sill and head as shown in FIG. 15. FIG. 15 illustrates a cross-section of the window construction taken along the sectional line 9—9. As can be seen, the sill wedge formerly attached to sill 13 has been replaced (in part) by deforming the side of the wall of sill 13 to form deformed metal wedge 230. Similarly, the upper sealing wedge has been removed and the head 10 deformed to form metal wedge 234 engaging tab 192. Both the new wedges formed, numbers 230 and 234, are struck with machine or other similar type press and the wedge formed in the metal, like its counterpart replaced, is a gradual incline in the direction of closing vent window 40.

Other noticible differences shown in FIG. 15, is that the sill wedge has been modified to cover only sill track 131. This may be adapted from the wedge shown in FIG. 12 by removing that portion connected with sealing wedge surface 177 including wall 175. Again the new modified sill wedge 232 begins with a zero thickness and terminates with a maximum thickness as has been previously described for the sill wedge. The modified sill wedge 232 is similarly installed with an adhesive upon sill track 131. Similarly, the intermediate sealing wedges 63 shown in FIG. 10, as taken at sectional line 10—10 of FIG. 1, may be replaced with the deformed metal wedge 230 illustrated in FIG. 14.

Figure 16:
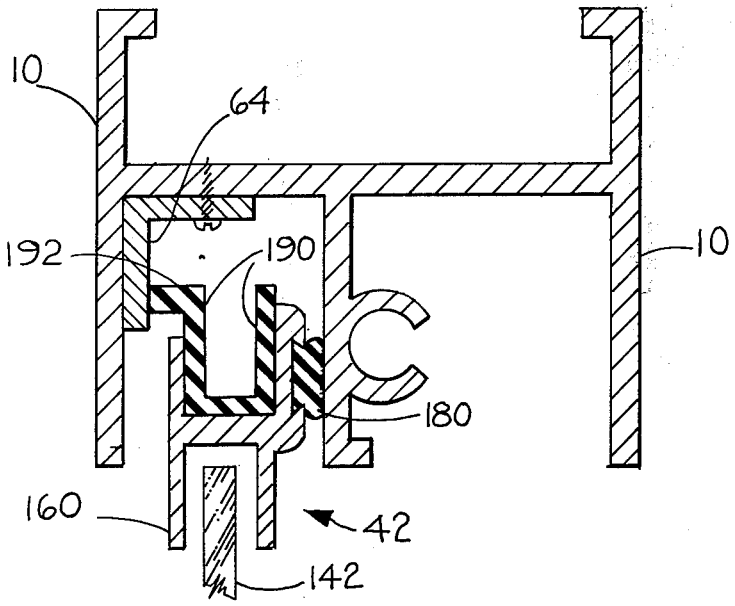
FIG. 16 is the top portion of the view taken along section line 9—9 for the second alternate embodiment.

A second embodiment of the invention which may be adapted is shown in FIG. 16 where, again, a cross-sectional view is taken through the area as indicated at line 9—9 of FIG. 1. Here the head 10 now utilizes an upper sealing wedge 64 instead of the tapered leg configuration of FIG. 9. With reference to FIG. 16, showing just the upper head 10 in relationship to the vent window frame top member 160 of line 9—9, upper sealing wedge 64 attaches to head 10 replacing tapered leg 11 (FIG. 9). Upper sealing wedge 64 is constructed such that the surface which is engaged by tab 192 rises evenly from a zero thickness joining the wall of head 10 to a maximum thickness as shown in FIG. 16. Thus as top member 160 is raised through action of the sill wedge 62, tab 192 rises to engage upper sealing wedge 64, first engaging upper sealing wedge 64 at its zero thickness end. Upper sealing wedge 64 is nominally an inch or so in length and is attached to head 10 by an adhesive or, as shown in FIG. 16, sheet metal screw means.

As is obvious, when the vent window is not riding up on the sill wedges, the tab 192 is located at a point below all parts of wedge 64 and thus would slide under wedge 64 were it not for the lifting sill wedges. Obviously therefore, as many sill wedges may be placed in head 10 as desired, each corresponding to a similarly located (when the window is closed) upper wedge insert 190. There should be at a minimum, two upper wedge inserts 190, one at each end of the window, and correspondingly two upper sealing wedges 64. These upper sealing wedges 64 should be located such as to be fully engaged by the upper wedge inserts 190 when the vent window is fully closed.

As top member 160 tab 192 engages the upper sealing wedge 64, top member 160 is forced against the center extending leg of head 10 where insulation weatherproofing strip 180 is compressed into the air and watertight configuration.

Still a third alternate embodiment of the subject invention would be to modify the first and second embodiments to replace the deformed metal wedge 230 formed in sill 13 shown in FIG. 15 with a tapered wall as shown in FIG. 9. To effect this embodiment, the sill 13 would merely have the indentations as shown in FIG. 15 filled with metal such that the tapered wall of sill 13 would rise and increase in thickness from the joinder of the flat central portion to the maximum point of the wedge as shown in FIG. 15.

A fourth alternate embodiment of the subject invention which has been previously referenced is to substitute individual or a plurality of plastic, metal, nylon, or teflon wedges for the wedge shaped portion 212 of jamb 14 (FIG. 11) and for tapered leg wedge 157 of mullion interlocker 30 (FIG. 5). As the knuckle of jamb stile 210 is continuous in its total length as is the knuckle or finger portion 141 of the vent window vertical piece 46, these individual wedges are similarly engaged by the aforesaid knuckles and the sealing objective is similarly accomplished.

A fifth alternate embodiment of the subject invention which has been previously referenced has been the use of the preferred embodiment plus all embodiments prefiously discussed in the construction of sliding doors, such as are used for entrances to a patio connected with a house. In the construction of sliding glass doors, heavier framework, such as the outer fixed frame, the fixed panel frame, and the vent window are employed, and the vent window becomes the sliding door. All of the inventive features hereinabove described are then applied to the door construction.

While a preferred embodiment and alternate embodiments of the invention have been shown and described, it would be understood that there is no intent to limit the invention by such disclosure, but rather, it is intended to cover all modifications and alternate construction falling within the spirit and the scope of the invention as defined in the appended claims.

I claim:

1. In a window and door construction, an improvement comprising:

(a) an outside frame structure having upper head and lower sill horizontal members, and vertical end jamb members, said outside frame structure defining adjacent first and second interior peripheral channels therein;

(b) a vertical central mullion interlocker member located within the head and sill horizontal members first interior peripheral channel intermediate the end jamb members defining a first and second opening in said outside frame structure, said mullion interlocker having adjacent first and second lengthwise channels therein;

(c) a fixed window panel interior to said outside frame structure first opening, said fixed window panel in air and watertight sealed relationship to said first interior peripheral channel and said mullion interlocker first lengthwise channel;

(d) a vent window panel interiorly to said outside frame structure second interior peripheral channel, said vent window panel movable upon sill track means attached to said sill horizontal member;

(e) sealing means attached, in part, to said outside frame structure and said vertical mullion interlocker member, said sealing means engaging and forcibly urging said movable vent window panel against said outside frame structure second interior peripheral channel wall and said mullion interlocker in an airtight and watertight configuration when said panel is in position closing said outside frame structure second opening; and (f) vent window seal actuating latch means interposed said movable vent window panel and said vertical mullion interlocker member, said latch means forcibly urging said movable vent window panel to a final closed sealed position, locking said vent window panel, and forcibly unsealing and opening said vent window panel.

2. The window and door construction as defined in claim 1 wherein said sealing means includes insulation means interposed said vent window panel and said outside frame structure and mullion interlocker, whereby when said vent window panel is closed, said insulation is placed in compression with said outside frame structure and mullion interlocker thereby effecting an airtight and watertight configuration.

3. The window and door construction as defined in claim 1 wherein said sealing means includes insulation means attached to the vent window panel whereby when said vent window panel is closed, said insulation is placed in compression with said outside frame structure and mullion interlocker thereby effecting an air and watertight configuration.

4. The window and door construction as defined in claim 2 wherein said sealing means attached to said outside frame structure and said vertical mullion interlocker member comprises a plurality of wedge means.

5. The window and door construction as defined in claim 3 wherein said plurality of wedge means comprises at least one sill track wedge means operably attached to said sill track, at least one head wedge means operably attached to said upper head member, at least one sill wedge means operably attached to said lower sill member, at least one wedge means operably attached to said mullion interlocker, and at least one jamb wedge means operably attached to said end jamb member whereby said vent window panel moving upon said sill track engages said sill track wedge means and is raised thereby to engage said upper head wedge means and lower sill wedge means, said vent window panel also engaging said mullion interlocker wedge means and end jamb wedge means; said upper head wedge means, lower sill wedge means, mullion interlocker wedge means and end jamb wedge means forcibly urging said vent window panel against the outer fixed frame and mullion interlocker in an airtight and watertight configuration.

6. The window and door construction as defined in claim 5 wherein said sill wedge means are situated within the said second interior peripheral channel of said lower sill horizontal member and said sill wedge means are inverted.

7. The window and door construction as defined in claim 4 wherein said head wedge means operably attached to said upper head member comprises a plurality of spaced-apart wedge means situated within said outer fixed frame second opening.

8. The window and door construction as defined in claim 5 wherein said head wedge means operably attached to said upper head member comprises wedge means formed in said upper head member.

9. The window and door construction as defined in claim 5 wherein said sill wedge means operably attached to said lower sill member comprises wedge means formed in said lower sill member.

10. The window and door construction as defined in claim 5 wherein said sill wedge means operably attached to the lower sill horizontal member comprises deformed lower sill member wedge means wherein said lower sill member second interior peripheral channel is deformed inward.

11. The window and door construction as defined in claim 5 wherein said head wedge means operably attached to said upper head horizontal member comprises deformed upper head member wedge means wherein said second interior peripheral channel is deformed inward.

12. The window and door construction as defined in claim 5 wherein said plurality of wedge means comprises wedges formed from durable material.

13. The window and door construction as defined in claim 5 wherein said plurality of wedge means comprises wedges constructed of plastic means.

14. The window and door construction as defined in claim 5 wherein said wedge means comprises wedges constructed of teflon means.

15. The window and door construction as defined in claim 5 wherein said wedge means comprises wedges constructed of metal means.

16. The window and door construction as defined in claim 5 wherein said vent window panel movable upon said sill track means comprises roller means operably attached to said vent window panel to roll upon sill track means.

17. The window and door construction as defined in claim 5 wherein said latch means comprises catch means attached to said mullion interlocker and handle means pivotally attached to said vent window panel, said latch means including lug means attached to said handle means whereby said lug means may engage said catch means and said vent window panel may be forcibly closed by coaction of said lug means against said latch means transmitted through said pivotal means to said vent window panel.

18. The window and door construction as defined in claim 17 wherein said latch means includes pin means attached to said handle means opposite said lug means from said pivotal means whereby when said vent window panel is closed and said latch means engaged, said latch means may be released by permitting said pin means to engage said catch means and withdraw and open said vent window panel.

19. The window and door construction as defined in claim 5 wherein said wedge means operably attached to said mullion interlocker comprises wedge means formed in said mullion interlocker.

20. The window and door construction as defined in claim 19 wherein said wedge means operably attached to said mullion interlocker comprises wedge means formed the whole length of said mullion interlocker.

21. The window and door construction as defined in claim 4 wherein said jamb wedge means operably attached to said end jamb member comprises wedge means formed in said end jamb member.

22. The window and door construction as defined in claim 21 wherein said jamb wedge means operably attached to said end jamb member comprises wedge means formed the whole length of said end jamb member.

23. The window and door construction as defined in claim 5 wherein said vent window panel comprises a plurality of wedge engaging tab means operably attached to the top and to the bottom of said vent window panel, said tab means projecting from said vent window panel whereby said tab means engage said sill wedge means and said head wedge means when said vent window panel is raised.

24. The window and door construction as defined in claim 23 wherein said vent window panel defines knuckle means operably attached to said vent window panel vertical sides, said knuckle means engaging said mullion interlocker wedge means and said end jamb wedge means and forcibly urging said vent window panel against said outer fixed frame and said mullion interlocker when window is closed.

25. The window and door construction as defined in claim 5 wherein said sill track wedge means comprises, in part, two spaced-apart sill track wedges situated proximate opposite sides of the outside frame structure second opening.

26. The window and door construction as defined in claim 25 wherein said sill wedge means operably attached to said lower sill member comprises, in part, two spaced-apart wedges situated proximate opposite sides of the outside frame structure second opening.

27. The window and door construction as defined in claim 26 wherein said sill track wedge means and said sill wedge means comprise one piece operably attached to said lower sill horizontal member within said second interior peripheral channel.

28. The window and door construction as defined in claim 26 wherein said sill wedge means operably attached to said lower sill member comprises a plurality of sill wedges between said two spaced-apart sill wedges.

* * * * *

UNITED STATES PATENT AND TRADEMARK OFFICE

CERTIFICATE OF CORRECTION

PATENT NO. : 4,114,317

DATED : Sept. 19, 1978

INVENTOR(S) : Richard K. Crawley

It is certified that error appears in the above-identified patent and that said Letters Patent are hereby corrected as shown below:

In the Claims: Column 16, Line 28, cancel "2", and insert in its place --3--; Column 16, Line 32, cancel "3", and insert in its place --4--; column 16, Line 57, cancel "4", and insert in its place --5--; Column 18, Line 8, cancel "4", and insert in its place --5--.

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*